US009869041B2

(12) United States Patent
Rovellini

(10) Patent No.: US 9,869,041 B2
(45) Date of Patent: Jan. 16, 2018

(54) APPARATUS FOR STRETCHING ACRYLIC FIBERS IN A PRESSURIZED STEAM ENVIRONMENT AND AUTOMATIC FIBER DRAWING-IN DEVICE FOR SAID APPARATUS

(71) Applicant: M.A.E. S.P.A., Piacenza (IT)

(72) Inventor: Marco Rovellini, Piacenza (IT)

(73) Assignee: M.A.E. S.P.A., Piacenza (IT)

( * ) Notice: Subject to any disclaimer, the term of this patent is extended or adjusted under 35 U.S.C. 154(b) by 62 days.

(21) Appl. No.: 14/893,330

(22) PCT Filed: May 20, 2014

(86) PCT No.: PCT/IB2014/061562
§ 371 (c)(1),
(2) Date: Nov. 23, 2015

(87) PCT Pub. No.: WO2014/188341
PCT Pub. Date: Nov. 27, 2014

(65) Prior Publication Data

US 2016/0102421 A1 Apr. 14, 2016

(30) Foreign Application Priority Data

May 21, 2013 (IT) ..... MI2013A0821

(51) Int. Cl.
*D02J 1/22* (2006.01)
*D06C 3/00* (2006.01)
(Continued)

(52) U.S. Cl.
CPC ..... *D02J 1/225* (2013.01); *D02J 1/222* (2013.01); *D02J 13/001* (2013.01); *D06B 17/00* (2013.01);
(Continued)

(58) Field of Classification Search
CPC .... D02J 1/22; D02J 1/222; D02J 1/225; D02J 13/001; D06B 23/14; D06B 23/16;
(Continued)

(56) References Cited

U.S. PATENT DOCUMENTS 1,914,024 A * 6/1933 Kasanof ..... D06C 3/00 101/424.1
2,520,202 A * 8/1950 Frearson ..... D06C 7/00 28/246
(Continued)

FOREIGN PATENT DOCUMENTS

DE 26 23 671 A1 12/1976
EP 1 061 163 A1 12/2000
(Continued)

OTHER PUBLICATIONS

International Search Report, dated Jan. 20, 2015, from corresponding PCT Application.

*Primary Examiner* — Amy Vanatta
(74) *Attorney, Agent, or Firm* — Young & Thompson

(57) ABSTRACT

A stretching apparatus of fibre tows in a pressurized steam environment includes an elongated stretching chamber having a generally rectangular section of a low height, within which the tows are treated with saturated or overheated steam at high temperature and pressure and simultaneously undergo a mechanical stretching operation. The stretching chamber has a width sufficient to house multiple tows mutually flanked in a running plane and is formed within a stretching chest made of aluminum. The stretching chest is housed in a supporting structure, having a higher structural rigidity than the stretching chest, which includes a plurality of contact elements apt to determine a predefined position of the stretching chest with respect to a direction perpendicular to the tow running plane and to allow a limited mobility of
(Continued)

the stretching chest in the other two mutually perpendicular directions which lie in the plane, length and width respectively.

25 Claims, 7 Drawing Sheets

(51) Int. Cl.

| | |
|---|---|
| ***D06B 23/18*** | (2006.01) |
| ***D06B 23/14*** | (2006.01) |
| ***D06C 7/00*** | (2006.01) |
| ***D02J 13/00*** | (2006.01) |
| ***D06B 17/00*** | (2006.01) |

(52) U.S. Cl.
CPC ..... *D06B 23/14* (2013.01); *D06B 23/18* (2013.01); *D06C 3/00* (2013.01); *D06C 7/00* (2013.01)

(58) Field of Classification Search
CPC ..... D06B 23/18; D06B 19/0035; D06B 19/0052; D06B 17/00; D06C 3/00; D06C 7/00; D06F 39/008; B29C 61/08; B29C 35/0277; B29C 35/049; B29C 39/065; B29C 35/06
USPC ..... 28/240, 246; 68/5 C, 6, 5 R, 5 B, 5 D, 68/5 E
See application file for complete search history.

(56) References Cited

U.S. PATENT DOCUMENTS 2,865,112 A * 12/1958 Annesser ..... F26B 13/001 34/242
3,503,100 A * 3/1970 Keith ..... D01G 1/10 19/0.46
3,761,977 A * 10/1973 Rappoport ..... D06B 5/02 68/5 D
3,868,215 A * 2/1975 Frezza ..... B65H 19/2253 26/81
4,059,668 A * 11/1977 Bittle ..... B29C 67/00 264/289.6
4,183,151 A * 1/1980 Frezza ..... D06C 5/00 26/81
4,641,504 A 2/1987 Runkel et al.
4,974,431 A * 12/1990 Kyle ..... D06B 19/0035 239/556
8,839,492 B2 9/2014 Mizutori et al.
9,175,429 B2 11/2015 Mizutori et al.
9,365,965 B2 * 6/2016 West ..... D06B 3/22
2004/0000176 A1 * 1/2004 Reese ..... D06B 23/18 68/5 R
2014/0123713 A1 * 5/2014 Mizutori ..... D01F 6/18 68/5 E

FOREIGN PATENT DOCUMENTS

| | | | |
|---|---|---|---|
| EP | 2674522 | B1 | 12/2013 |
| JP | 4710803 | Y | 4/1972 |
| JP | 2008-214795 | A | 9/2008 |
| JP | 2008-240203 | A | 10/2008 |
| JP | 2009-256820 | A | 11/2009 |
| KR | 10-2012-0090126 | A | 8/2012 |
| WO | 2012/108230 | A1 | 8/2012 |
| WO | 2012108230 | A1 | 8/2012 |
| WO | 2012/120962 | A1 | 9/2012 |

* cited by examiner

APPARATUS FOR STRETCHING ACRYLIC FIBERS IN A PRESSURIZED STEAM ENVIRONMENT AND AUTOMATIC FIBER DRAWING-IN DEVICE FOR SAID APPARATUS

The present invention relates to an apparatus for stretching acrylic fibres in pressurized steam environment, in particular for acrylic fibres used as precursors in a carbon fibre manufacturing process, and to an automatic drawing-in device for said apparatus.

FIELD OF THE INVENTION

Carbon fibres consist of thin filaments, usually continuous or of a predetermined length, having a diameter of 2.5-12 μm, preferably 5-7 μm, mainly consisting of carbon atoms. Carbon atoms are mutually bonded in a crystal matrix, wherein the individual crystals are aligned, to a greater or smaller extent, along the longitudinal axis of the fibre, thereby imparting to the same an extraordinarily high resistance compared to the size thereof.

Various thousands of carbon fibres are then mutually gathered to form a thread or a tow and this can then be used as it is or woven in a loom to form a fabric. The yarn or fabric thus obtained are impregnated with resins, typically epoxy resins, and then molded to obtain composite products showing a high lightness and resistance.

Carbon fibres represent the transition point between organic and inorganic fibres; as a matter of fact, they are manufactured starting from organic fibres which are modified through thermo-mechanical treatments and pyrolysis, during which first a reorientation of the molecular segments within the individual fibres takes place and subsequently, at higher temperatures, the removal of oxygen, hydrogen and of most of the nitrogen occurs, so that the final fibre consists of over 90% and up to 99% of carbon and for the rest of nitrogen.

At present carbon fibres are produced by modifying artificial fibres (industrially rayon, experimentally lignin) or synthetic (polyacrylonitrile for at least 90% of the world production, but also PBO and, experimentally, other thermoplastic fibres) or of residues of oil distillation or tar distillation (bituminous pitches).

STATE OF THE PRIOR ART

In the case of the carbon fibres obtained by modifying polyacrylonitrile (PAN) synthetic fibres, in which field the present invention is comprised, the starting polyacrylonitrile fibre (the so-called precursor) must be characterized by a suitable chemical composition, by a special molecular orientation and by a specific morphology, so that a final carbon fibre with satisfactory structural and mechanical features may be obtained from the same. The molecular orientation imparted to the source acrylic fibre, through different stretching treatments, as a matter of fact positively affects the structural evenness and hence the tenacity and the elastic modulus of the final carbon fibre; however, the stress induced in the fibre during the stretching operations must not be excessively high because in this case structural defects would be introduced, both superficially and within the fibre.

The desired change of the molecular orientation and of the morphology of the polyacrylonitrile synthetic fibre is obtained through a mechanical stretching treatment of the fibre at a high temperature. Traditionally, stretching operations of this type are carried out in hot water (wet stretching)

with subsequent retraction retaining treatment on sets of 12-60 steam-heated rollers on which the fibre is caused to run. The rollers have controlled speeds and temperatures so that the fibre is first progressively dried and then stabilised and caused to collapse. By this last term the filling of the micro-gaps is intended, which micro-gaps are caused within the fibre by the removal of spinning solvent through diffusion in water, and by the subsequent evaporation of this last.

Apparatuses of the type illustrated above, widely in use in the textile industry, however, do not give satisfactory results when the PAN fibres must then be used as precursors of carbon fibres, due to the fact that through a wet process it is not possible to reach the high final stretching ratios required for a good orientation of the molecules, in view of the subsequent processing steps. As a matter of fact, only the plasticizing action of saturated steam at high temperatures (from 120° C. to 190° C.) on the acrylic polymer allows to obtain such stretching ratios (from 1.2 to 4 on finished and no longer wet stretchable fibre), with stretching ratios allow to get the best results in terms of quality of the obtained fibre, in view of the requirements of the subsequent fibre oxidation and carbonization steps.

As a matter of fact, it has already been proposed by a number of earlier patents to carry out the stretching operations in a saturated or overheated steam environment. When saturated steam is present in the stretching area, in fact, it allows to obtain a very quick and even transfer of latent condensation heat within the tow of fibres. At the same time, the condensetion water which forms on the fibres at high temperature has a plasticizing effect on the same allowing to increase the stretching ratio without the need to increase the stretching stress to such levels which would introduce structural defects in the fibres. Moderate steam overheating is often adopted for preventing the danger of a previous condensation within the stretching apparatuses.

Stretching operations with pressurized saturated or overheated steam are carried out in suitable apparatuses in which the fibres to be treated are caused to run within a chamber fed with saturated or overheated steam; said chamber comprises steam seals, normally of the labyrinth type, at the fibre inlet and outlet openings, to limit steam losses. In addition to the limitation of steam consumption, the other main problem which must be addressed when designing these apparatuses consists of the accidental chafing contacts which may occur between the travelling fibres and stationary parts of the apparatus, which contacts cause of course an undesired wear of the fibres due to surface damage, local overheating or increased stress downstream of the contact point, which wear may cause a possible tear of individual filaments. This then triggers further frictions and jams which can lead even to the breakage of a whole tow.

Depending on the section shape of the stretching chamber, currently known stretching apparatuses can be substantially classified into three categories:

1. Apparatuses with small-sized, circular-section stretching chambers, with chambers have a diameter equal to the distance between the running axes of adjacent tows o at most to twice said distance, consisting of one or more tubular elements in each one of which a single fibre tow is caused to run;
2. apparatuses with large-sized, circular-section stretching chambers, similar in their layout to steam accumulators but provided with labyrinth seals at the ends thereof, apt instead to house multiple flanked tows of fibres. The huge amount of steam contained in said apparatuses, with resulting extended filling and emptying times, and the difficulty of controlling the thermal deformations of the same, have highly limited the development thereof, so that in the present description they are not further commented upon;

3. apparatuses with low-height, rectangular-section stretching chambers, apt to house multiple flanked tows of fibres.

JP-2008-214795 and JP-2008-240203, both in the name of Toray Industries Inc., disclose apparatuses of the first type wherein a fibre tow of 4K-12K having a count of 3.0-6.0 dtex is treated in a pressurized steam chamber at 0.45-0.70 MPa. The outgoing stretched fibres have a count of 0.5-1.5 dtex.

JP-2009-256820 and WO-2012-108230, both in the name of Mitsubishi Rayon Co., disclose rectangular-chamber apparatuses in which multiple flanked tows are treated. Preferred dimensional values of the single elements of the labyrinth seals are defined (height/pitch ratio below 0.3) and of the distance between upper and lower seal (<0.5 mm) when the apparatus is at its operating temperature (140° C.). Different types of stiffening structures are also described, in order to limit the thermal deformations of the apparatus.

KR-2012-0090126, in the name of Kolon Inc., discloses another type of rectangular-chamber stretching apparatus.

WO-2012-120962, in the name of Mitsubishi Rayon Co., discloses a rectangular-chamber apparatus in which there are further provided, in the areas of the pressure seals, vertical partitions which laterally limit the running path of each individual tow, in order to limit steam losses and avoid any interaction between adjacent tows.

The apparatuses with circular-section stretching chamber of the first type have the advantage of fewer mechanical stresses compared to the other solutions and consequently they allow reduced thicknesses of the mechanical structure thereof. Housing a single tow, the labyrinth seal can have an opening strictly limited to the running requirements of the same, which opening can be both of a circular shape and shaped as a rectilinear slit. The first shape is the one which minimises the free area in the tow inlet and outlet areas into and from the apparatus, and hence steam losses, but forces the tow, naturally planar, to take up a circular shape. Conversely, the manufacturing of seals which do not generate turbulences is complex and expensive in these apparatuses and furthermore does not allow the opening of the apparatus, which as a result cannot be inspected inside but disassembling components. The circular-section seal must furthermore have a small diameter (<3 mm) in order not to have excessive steam losses and this makes it unsuitable to treat tows larger than 3K-6K. Even coupling multiple tubular chambers into a single apparatus, it is hence a low-productivity apparatus.

Rectangular-chamber stretching apparatuses are instead of a simpler construction; moreover, being able to house multiple flat tows, mutually flanked, each one of a large size, for example 24K, high productivity values can easily be achieved. Conversely, steam losses through the wide rectangular openings for tow inlet and outlet are remarkable and this implies higher running costs. Moreover, in rectangular-chamber apparatuses the thermal expansions which the apparatus undergoes when it is brought to the operating temperature are very high, precisely due to the great length and width dimensions of the apparatus itself; such expansions, unlike what happens in apparatuses with circular-section chamber, are furthermore not symmetrical with respect to the tow path. Apparatus arching and twisting hence easily occur, both in a transversal and in a longitudinal direction, which increase the opportunities of chafing contacts between the fibres being treated and stationary parts of the apparatus, with the already seen problems of wear and of possible fibre breakage.

Finally, in all the types of apparatuses described above the initial drawing-in operations are rather work-intensive due to the closed construction of the stretching chambers, of the great length thereof and of the low height free for the passage of the tows. In case of breakage of a tow it is hence necessary to halt the production line, to then be able to proceed to the new drawing-in of the same. This drawback is of course more serious in case of rectangular-chamber stretching apparatuses, where the breakage of a tow necessarily causes either the interruption of the processing on all the other still-integer tows, to proceed to the drawing-in operations of the broken tow, or the discarding of the entire production of the broken tow until the end of the batch being produced, both being options involving a high economic cost.

In the textile-derived plants, the precursor is typically manufactured on a large scale and the individual fibres are collected in bundles or tows containing up to 300,000 single filaments; the smallest tows manufactured in this type of plants contain, for example, 48,000 filaments (so-called 48K). For this type of plants the adoption of circular-chamber (one for each tow) stretching systems, as previously described, is not practicable and they must hence necessarily be treated in rectangular-chamber stretching apparatuses. Similarly, plants exist specifically set up for the manufacturing of low-denier tows, where manufacturing occurs on a small or medium scale with the production of 1K, 3K, 6K and 12K tows. In these plants, the stretching of the tows in a pressurized saturated steam environment can be carried out in apparatuses with circular-section chambers, of course with a single tow for each chamber.

The carbon fibres manufactured in the first type of plants have a lower manufacturing cost, given by the high manufacturing capacity of such plants, but have a lower degree of evenness, and are hence more suited for industrial uses. The carbon fibres manufactured in the second type of plants are instead more even and are more appreciated by the aeronautical industry, where there is already a consolidated habit of using smaller-size carbon fibre tows.

Problem and Solution

The stretching apparatus of the present invention pertains to the third one of the categories of stretching apparatuses described above, i.e., those having a rectangular stretching chamber, with the object of removing the main drawbacks shown by this type of machines so far, as briefly recalled above, i.e., chafing of the fibres on stationary parts of the apparatus, following thermal deformations of the same; high steam losses from the tow inlet and outlet openings; impossibility of carrying out the drawing-in of broken tows during apparatus operation.

A first object of the invention is hence that of providing a mechanical structure of the stretching apparatus in a saturated or overheated steam environment, to be used preferably within a manufacturing process of carbon fibres, which can withstand the thermal expansions consequent to the high treatment temperatures, without geometric modifications of the stretching chamber.

Another object of the invention is then that of providing a steam stretching apparatus which has an improved structure of the labyrinth pressure seals, without fibre contact, in correspondence of the tow inlet and outlet openings, so as to determine a reduced steam consumption through the same.

Finally, a further object of the invention is that of providing a device for the automatic drawing-in of damaged or broken tows, which allows to perform the drawing-in operation of a broken tow without interrupting the operation of the stretching apparatus on the other integer tows.

This problem is solved and these objects are achieved, according to the present invention, through a stretching apparatus in a pressurized saturated or overheated steam environment having the features defined in claim 1 and an automatic drawing-in device for such apparatus having the features defined in claim 22. Other preferred features of such apparatus and of such device are defined in the auxiliary claims.

BRIEF DESCRIPTION OF THE DRAWINGS

Further features and advantages of the stretching apparatus in a pressurized saturated or overheated steam environment according to the present invention will in any case be more evident from the following detailed description of a preferred embodiment of the same, only given as a non-limiting example and illustrated in the attached drawings, wherein.

DETAILED DESCRIPTION OF THE PREFERRED EMBODIMENT

Figure 6:
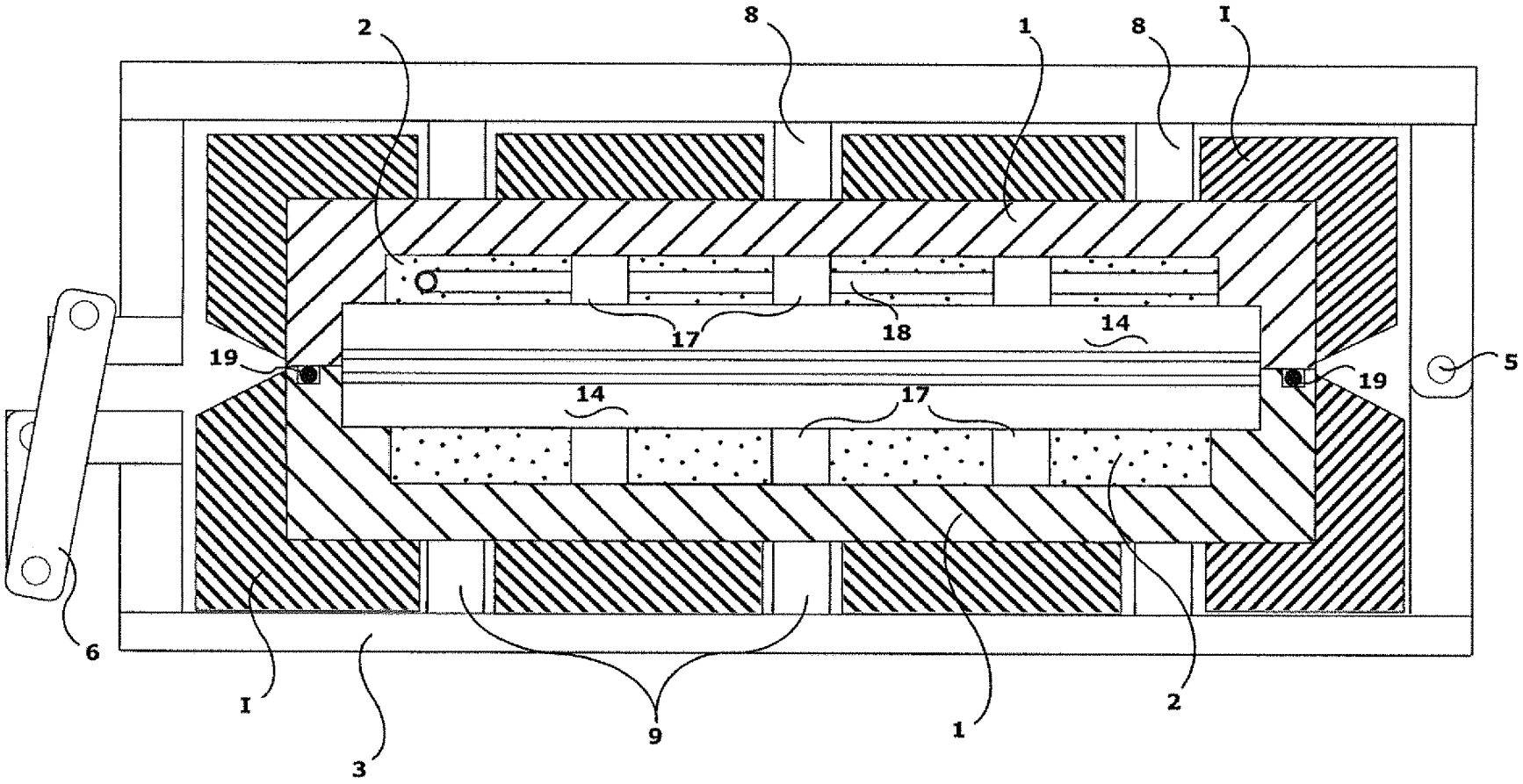
FIG. 6 is a cross-section view of the stretching apparatus of FIG. 4, according to the line VI-VI of FIG. 2.

In order to treat a plurality of tows T arranged side by side, obtaining improved results in terms of effectiveness, reduced cost and accessibility, the stretching apparatus of the present invention comprises a stretching chest 1, of a general parallelepiped shape consisting of two opposite portions, comprising seals provided with suitable gaskets 19 (FIG. 6) at the two opposite longitudinal edges, said portions being suitably shaped inside to jointly form a steam stretching chamber 2. This inner steam stretching chamber 2 is of a very reduced height (7-10 mm) and of the width strictly necessary for housing the set of flanked tows T and possibly the drawing-in device which will be addressed better in the following. This arrangement allows to simplify the manufacturing operations and moreover to dramatically reduce the volume of the steam stretching chamber 2 compared to that of a conventional, rectangular-section stretching chamber which processes the same amount, of tows, with a corresponding reduction of the steam amount within chamber 2. In the start/stop operations and/or of apparatus maintenance a considerable reduction of the depressurisation/pressurisation times of chamber 2 is hence obtained.

In order to obtain the maximum temperature evenness within the steam stretching chamber 2 ($\Delta T° \leq 1°$ C.), the two portions of the stretching chest 1 are built of a metal material having high thermal conductivity. Aluminium, or aluminium-based light alloys, are preferred materials for this purpose, because they combine good mechanical properties and a low specific weight with excellent thermal conductivity.

As stated in the preliminary portion of the disclosure, steam stretching chamber 2 must contain saturated or overheated steam at high temperature and pressure; the standard conditions within chamber 2 can hence vary in a temperature range of 120-190° C. and in a pressure range of 1-10 bar. Preferably, the optimal operating condition lie between 140° and 165° C. (2.5-6 barg). In these conditions of temperature and pressure, stretching chest 1 must be suitably supported in order that the two portions making it up be able to remain securely in mutual contact in the desired position, despite the very high loads exerted by the inner pressure of the steam on the inner walls of said portions, in the opening direction of the stretching chest 1. However, if stretching chest 1 was supported by a frame with conventional hyperstatic structure—i.e., comprising a plurality of constraint points—due to the high thermal gradient between the rest conditions and the operating conditions, it would have utterly unacceptable thermal deformations. As a matter of fact, considering the remarkable overall size of chest 1 (for example 800-1400 mm width and 6000-10000 mm length) and the reduced size of the height of the inner steam stretching chamber 2 (in some points only 7-10 mm between the steam distribution plates), it is clear that the thermal expansion of chest 1 in operating conditions would imply, due to the presence of said plurality of constraint points, misalignments (arching or twisting) of the same compared to the rest conditions, both in a longitudinal and in a transversal direction, such as to easily determine a possible contact of tows T travelling through the apparatus with the inner walls of the steam stretching chamber 2 and, in particular, with the inlet and outlet slits of said chamber and with the relative pressure seals which, as will be shown better in the following, have very short free heights (0.3-2 mm, preferably 0.5-1 mm).

However, the provision of a low overall height of the steam stretching chamber 2 and of an even more reduced height of the respective inlet and outlet openings and of the pressure seals is—as stated above—an essential condition for reaching the desired operating effectiveness of the apparatus, in terms of short pressurisation and depressurisation times, very low temperature gradients along stretching chest 1 and little steam consumption. In order to meet these opposite requirements, the inventors of the present application have hence assumed to use an innovative supporting structure of the stretching chest 1 which, despite allowing the maintenance of a predefined position of the two portions of chest 1 with respect to the opening direction of the same (z axis, or direction perpendicular to the running plane of tows T), allowed instead a mobility of the two portions forming chest 1 in the other two perpendicular directions which lie in the plane of said portions (x and y axes, longitudinal and transversal, respectively), sufficient to allow the thermal expansion of the two portions of the chest in these two directions. Moreover, such supporting structure has a greater structural rigidity compared to that of the stretching chest 1 and it is thus able to forcedly maintain the stretching chest planar, preventing the inner stresses due to the thermal expansion which develop in the same during operation from causing arching and twisting of the chest. Finally, such supporting structure is separated from "hot" chest 1 by a suitable thermal insulating material, so as to maintain the supporting structure at a "cold" temperature next to room temperature, and hence not such as to cause in the same any significant thermal expansion problem. The present invention has hence developed based on these intuitions and on the implementation of the same in technical embodiments concretely applicable and of an industrially acceptable cost. Such embodiments are now going to be illustrated in detail, with reference to FIGS. 3-6.

Figure 3:
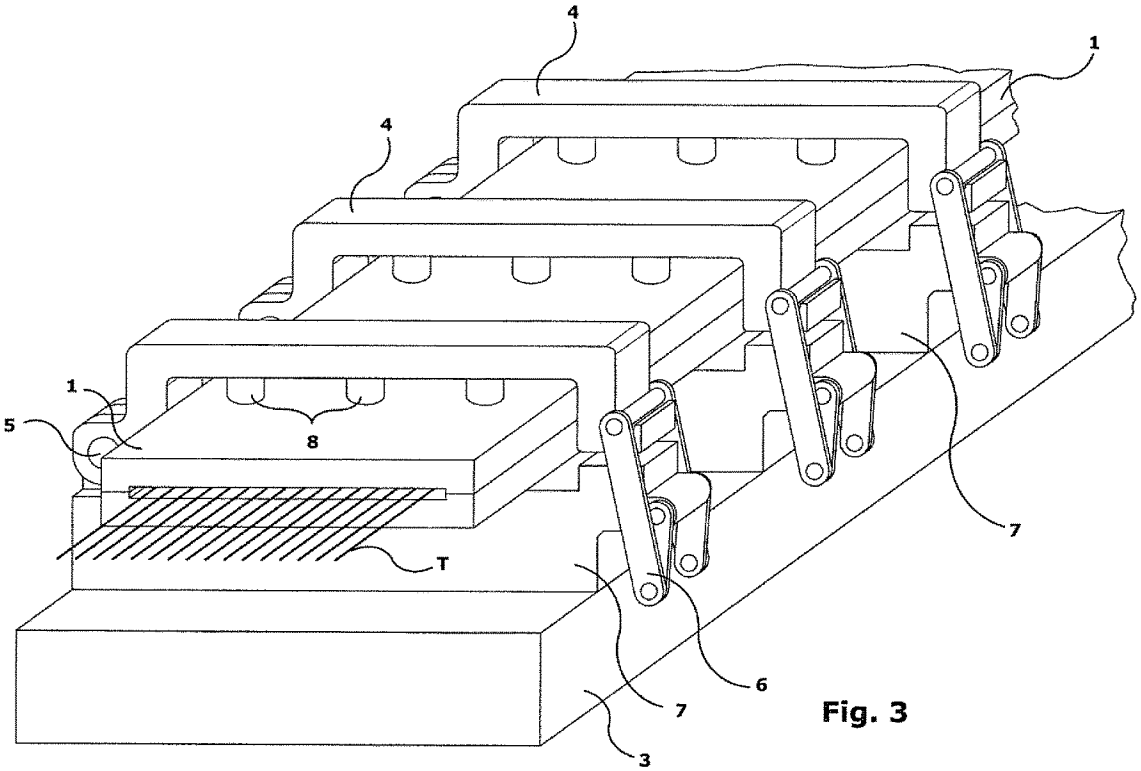
FIG. 3 is a perspective view from above which schematically illustrates a first embodiment of an end portion of the stretching apparatus according to the present invention.

The supporting structure of stretching chest 1 consists of a sturdy steel base frame 3 on which a series of mutually parallel collars 4 are anchored perpendicular to the longitudinal direction of chest 1. The anchoring of collars 4 is preferably carried out through a hinge 5, at one end of each collar, and a lever tie rod 6 at the opposite end. The lever tie rod 6, preferably is of the type which provides a safety position (for example of the three, unaligned hinging axis type) to prevent the accidental opening of the tie rod when stretching chamber 1 is brought into pressure. Depending on the various embodiments illustrated, hinges 5 and tie rods 6 can be fastened directly to base frame 3 (FIG. 4) or to crossmembers 7 projecting from base frame 3 and integral therewith which determine, with the upper surfaces thereof, the resting plane of the lower wall of stretching chest 1 (FIG. 3). Preferably collars 4 are furthermore made mutually integral by a longitudinal post (not shown) apt to allow the simultaneous lifting/lowering of all collars 4.

Collars 4 act on the upper portion of stretching chest 1 through contrast rods 8, the position of which can be adjusted through a screw coupling between said contrast rods 8 and collars 4. The position of the contact heads of contrast rods 8 with the upper wall of chest 1 can hence be adjusted micrometrically so that the upper wall of chest 1 takes on a perfectly planar shape when resting against such contact heads, when steam stretching chamber 2 is brought to temperature and pressurized. In order to allow a fine adjustment of the position of the contact head of contrast rods 8 with the upper wall of stretching chamber 1, the above-said screw coupling is of the mutually-opposite, double-thread type, so as to obtain a very short (0.5 mm) axial displacement of the screw for each full revolution of the same and hence a highly accurate opportunity for fine adjustment.

The supporting structure of above-described stretching chest 1 has been devised by the Applicant in order to allow the walls of stretching chest 1 to move without restrictions in the different direction of axes x and y following the thermal expansion resulting from the heating of said walls at the operating temperature. In order to obtain a better control on the direction in which such thermal expansion occur and to make the same expansion consistent between the two walls of stretching chest 1 it is preferable for each of such walls to have a single fixed point in a predetermined position and that all the other points of contact have a friction resistance as low as possible in the directions of axes x and y.

The fixed point of the upper portion of chest 1 is obtained by securely fixing, for example by welding or screw means, the contact head of a single contrast rod 8 to the respective outer wall of the upper portion of chest 1, so that the position of this rod represents the fixed reference point for said portion. Preferably, said rod is the central one of the collar 4 arranged in correspondence of the centre-line of chest 1, so that the fixed reference point coincides with the central point of the upper portion of chest 1, thus minimising the width of the mutual movement between the upper portion of chest 1 and the contact heads of all other contrast rods 8.

The fixed point of the lower portion of chest 1 is obtained in a fully similar way by using support rods 9 directly fastened to base frame 3 (FIG. 4) or to the upper part of crossmembers 7. Also in this case, only one of supporting rods 9, and preferably the one arranged in correspondence of the centre of the outer wall of the lower portion of stretching chest 1, is anchored to said wall, while all the others have a simple chafing contact which does not limit the movement of the lower portion of chest 1 with respect to the thermal expansion it undergoes.

In order to minimise the friction between contact heads of contrast rods 8 or of supporting rods 9 and the outer surfaces of the two portions of chest 1, and also to avoid problems of wear of such surfaces, in correspondence of the operating area of each one of rods 8 and 9 an insert of hardened steel is inserted and secured in the corresponding portions of chest 1, for example with a threaded coupling. Some of such inserts, and preferably the ones arranged in correspondence of the longitudinal axis of said walls of chest 1, can have also guiding grooves provided with lateral shoulders within which a mushroom-shaped end of a contact head of contrast rods 8 or of supporting rods 9 can be housed. This particular coupling hence always allows a degree of freedom to the affected portion of the wall of chest 1 along the longitudinal x axis, but does not instead allow a displacement of such wall portion along the crosswise y axis, thus defining that such axes maintain in any case steady directions. This solution furthermore allows to make the upper portion of chest 1 integral with collars 4, so that chest 1 may be simply opened by causing collars 4 to rotate around hinges 5, after having unfastened lever tie rods 6.

Since the mechanical contact between the supporting structure of the above-described stretching chest 1 and the chest itself consists only of contrast rods 8 and of supporting rods 9, it is possible to cover externally the walls of chest 1 with a suitable thickness of insulating material I, so as to minimise heat transfer outside the chest and to hence maintain the supporting structure substantially at a "cold" temperature, next to the room temperature. At this temperature thermal expansion is fully negligible and in this way any possible thermal deformation problem of base frame 3 and of collars 4 is avoided, which may otherwise impair the desired dimensional stability of stretching chest 1. The above-described arrangement makes stretching chest 1 an independent unit, which can be easily opened and easily removed from the corresponding supporting structure, thus making very easy and fast both the drawing-in of the tows and the maintenance and/or the replacement of the two portions of chest 1 to adapt them to different processes or to fibres of different materials.

The inlet of the overheated and pressurized steam into steam stretching chamber 2 is performed in two positions symmetrically arranged with respect to the centre-line of chest 1, through inlet ports 10 formed in the lower wall of chest 1 and the steam is evenly distributed in chamber 2 through a perforated distributor 11. The condensation water collects at the opposite ends of chamber 2 and is discharged through outlet ports 12.

At both ends of chest 1, in correspondence of horizontal slits 13 for fibre inlet/outlet, according to the invention pressure seals are formed capable of imparting a great loss of load to the steam and thus of minimising steam losses through said slits 13. The two pressure seals have identical shape, so that the description will be given only for the pressure seal in correspondence of the inlet slit of tows T illustrated in cross-section in FIG. 4 and, in an enlarged scale, in the detail of FIG. 5.

Said pressure seal consists of two opposite plates 14, each one integral with a respective wall of the stretching chest 1, mutually facing at a short distance ranging between 0.3-2.0 mm, preferably of 0.5-1 mm. The inner surface of opposite plates 14 is provided with a series of symmetrically opposite, parallel grooves, having a direction perpendicular to the sliding direction of tows T, which hence form a succession of deeper compartments, separated by bottlenecks in correspondence of the non-grooved areas of opposite plates 14. When passing through each one of these compartments the steam experiences a load loss ΔP equal to a certain percentage of the inlet pressure so that, by accurately sizing the length of plates 14, it is possible to obtain a sufficiently low pressure towards the outer side of the pressure seals as to minimise in the desired extent the steam losses from the steam stretching chamber 2. A satisfactory length L of plates 14 for this purpose, depending on the distance A between said plates and on the value of pressure P of the steam within steam stretching chamber 2, may be calculated with the following approximate criterion:

$$L=A\times K\times P$$

wherein coefficient K takes on the experimental value of 1000, when the lengths are expressed in mm and the pressures in barg.

The preferred shape for the grooves formed in the inner part of plates 14 is the one illustrated in the drawings, that is a Greek fret-like, right-angle and sharp-edge section; other shapes are of course possible for said grooves even though the one indicated above has proved to be the most effective for guaranteeing a pneumodynamic effect by the outgoing steam sufficient to support in a centred manner tows T in the bottleneck areas and to hence avoid any possible contact of tows T with plates 14. In fact, the pneumodynamic centring of tows T within the bottleneck areas of the pressure seals is so effective as to allow the replacement of the costly chromium plating or ceramic-coating procedure—which in the prior art is applied to all parts of the apparatus in possible contact with fibres—with a much cheaper Teflon-coating or nickel/coating process which as a matter of fact is used in the present invention exclusively for reducing the frictions in the initial transient phases an hence has a fully satisfactory duration.

A correct sizing of the grooves formed on the inner wall of plates 14—having indicated with B the length of the bottleneck areas, with C the pitch of the toothing in a longitudinal direction and with D the depth of the compartments formed by the opposite grooves (FIG. 5)—can be obtained maintaining said values within the conditions reported below:

$$2/10C\leq B\leq 5/10C10A\leq C\leq 20A6\leq D\leq 15A$$

where A represents, as above, the distance between opposite plates 14.

When passing inside the above-described pressure seals, and preferably in the outlet pressure seal, travelling tows T are finally preferably treated with a flow rate of overheated water H (FIG. 5), possibly charged with a finishing material, pouring said water into one of the innermost compartments of the pressure seal.

Figure 4:
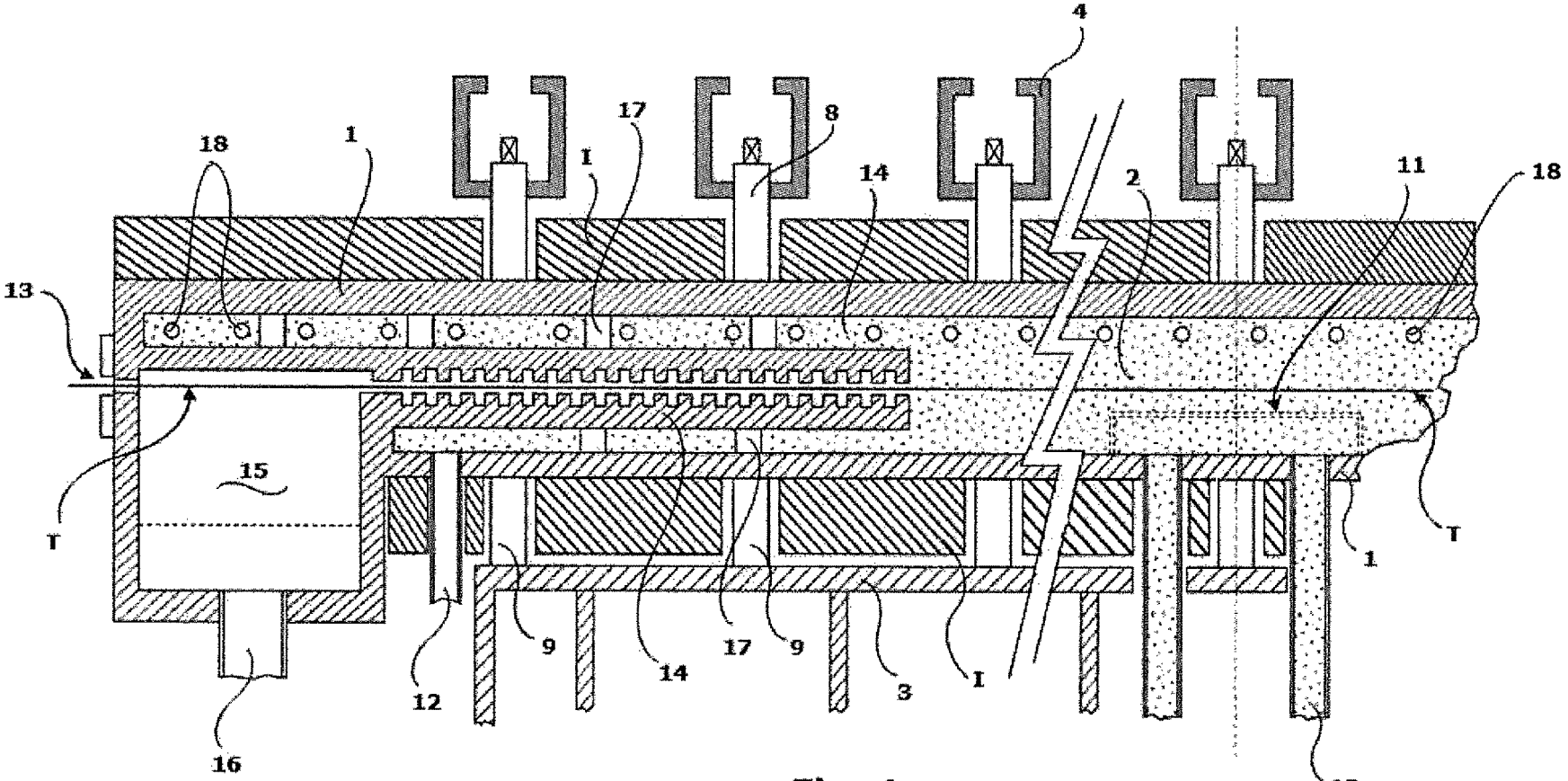
FIG. 4 is a longitudinal-section view of a second embodiment of the end portion of the stretching apparatus according to the present invention, according to the line IV-IV of FIG. 2.
Figure 5:
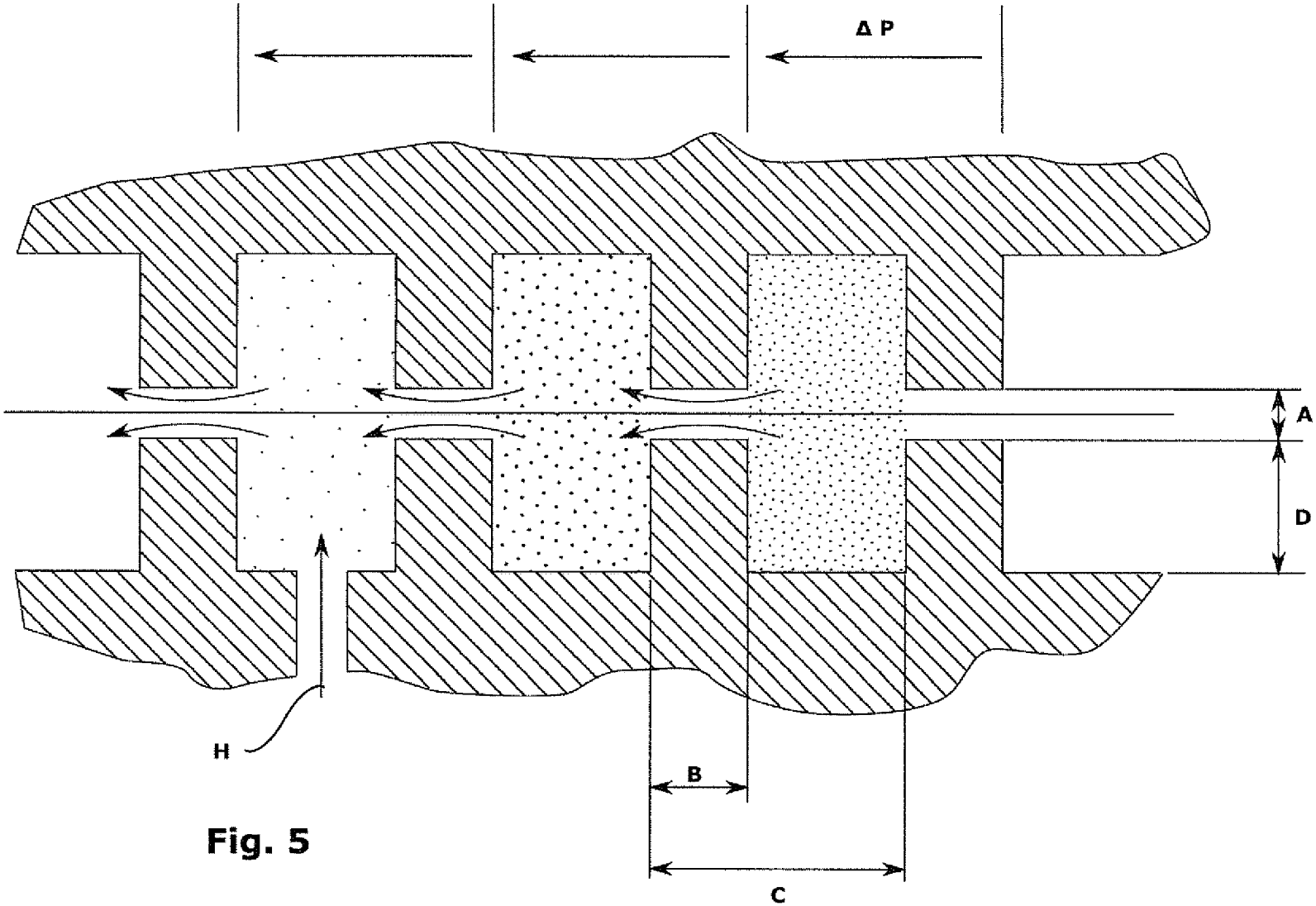
FIG. 5 is an enlarged-scale section view of a portion of the pressure seal illustrated in FIG. 4.

As it is evident from the examination of FIG. 4, the pressure seals of the steam stretching chamber 2 do not lead to directly outside the apparatus of the invention, but within a wide empty space, or suction hood 15, in which the slit 13 for the inlet/outlet of tows T also opens, on the opposite side of the above-said pressure seal. Suction hood 15 is furthermore connected in 16 to a suction fan which maintains a slight depression within hood 15, sufficient for avoiding steam leaks from slit 13, maintaining a slight air flow through slit 13 directed to the inside of suction hood 15. The flow rate of such air flow may be adjusted choking inlet/outlet slit 13 through an adjustable-position diaphragm applied externally to said slit.

Plates 14 extend within chamber 2, so as to be surrounded by the overheated steam inserted into said chamber and be thus maintained at a high temperature. This clever device prevents that within the seals a condensation of the outgoing steam may occur on the walls, which condensation might cause problems to the fibres dripping onto tows T. However, precisely due to this type of construction, plates 14 are evidently subject to a differential pressure, increasing towards the outer end thereof, since the pressure within the seals gradually decreases, while the one outside the seals (i.e., within chamber 2) is constant. Therefore, to avoid that such differential pressure may in time lead to deformations or deflections of plates 14, such plates are mechanically connected to the adjoining walls of chamber 2 through rigid connecting elements 17.

As is furthermore evident from FIG. 4, steam stretching chamber 2 extends also above suction hood 15, in order to keep also the upper wall of the same warm and hence prevent condensation from forming on such wall, which condensation might drip onto tows T, deteriorating the quality thereof. Still for the purpose of preventing condensation from forming above the entire path of tows T, in the entire upper area of the steam stretching chamber 2 a heating coil 18 is finally arranged, fed with overheated steam, which maintains this area constantly above the dew temperature and hence avoids any problem of condensation forming on the inner wall of the upper portion of the stretching chest 1.

Figure 1:
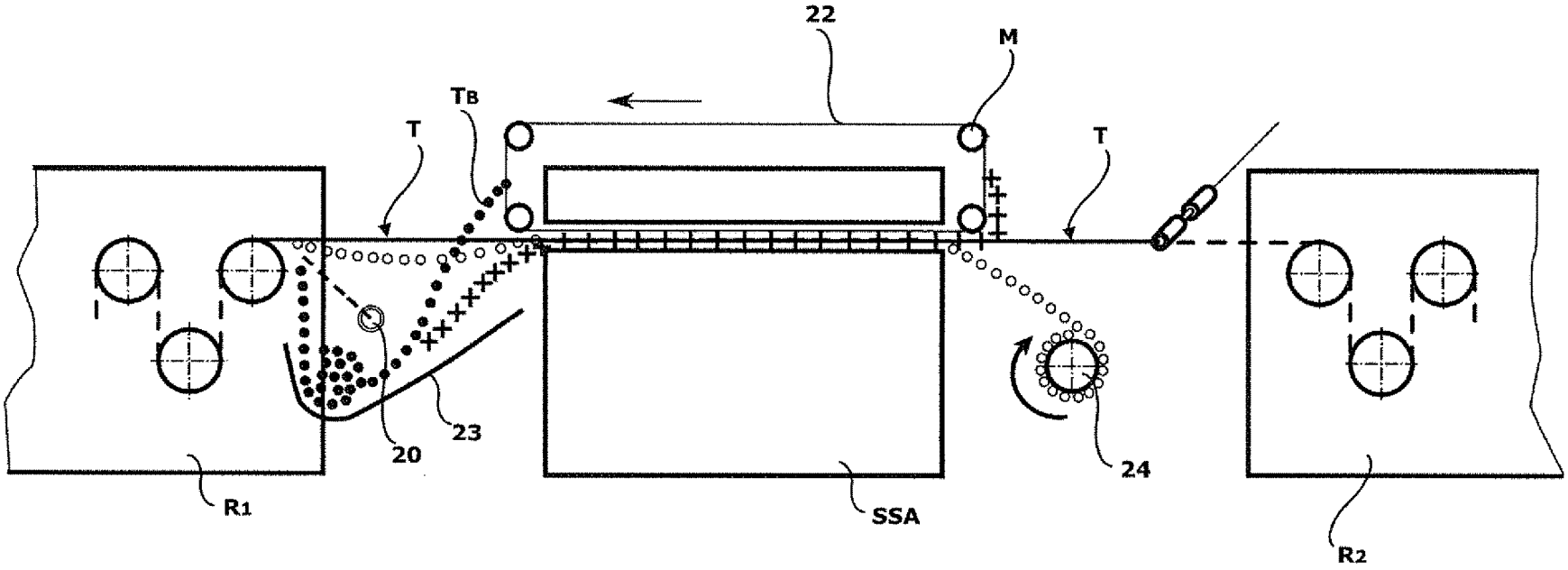
FIG. 1 is an overall front elevation view of the stretching apparatus according to the present invention and of a drawing-in device associated therewith.
Figure 2:
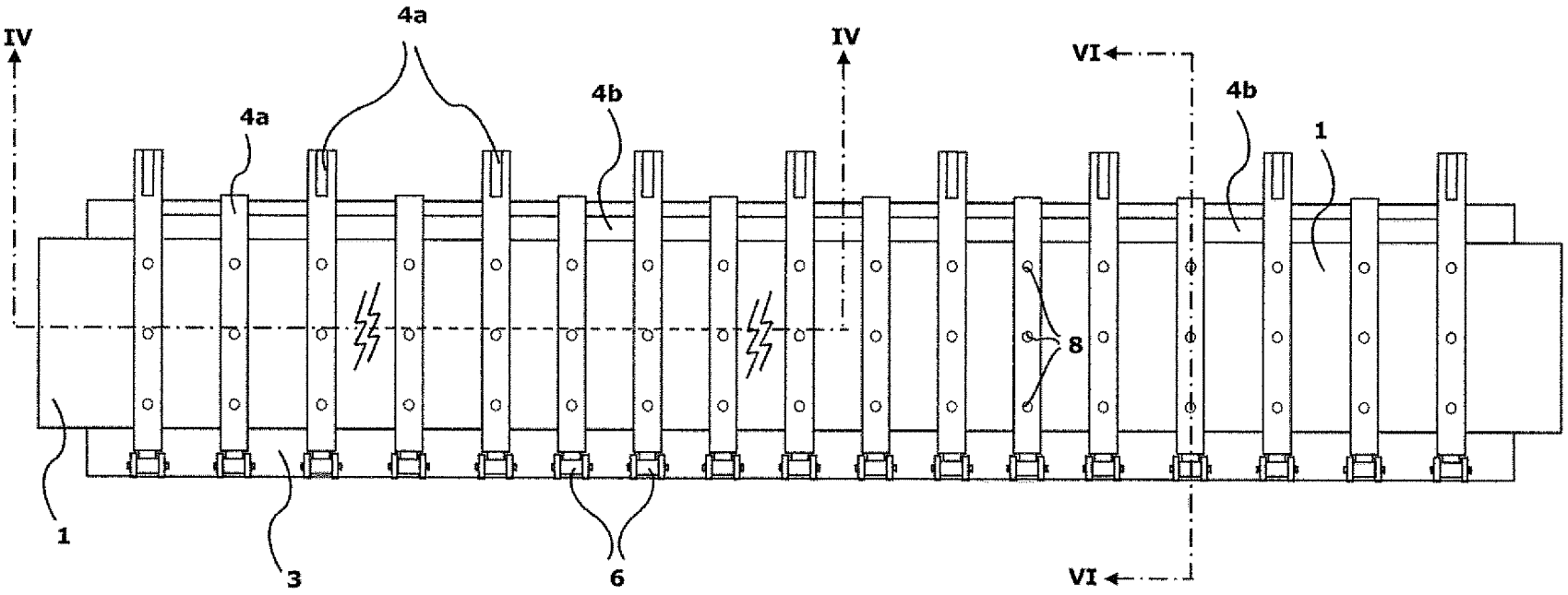
FIG. 2 is an overall top plan view of the apparatus of FIG. 1.
Figure 7:
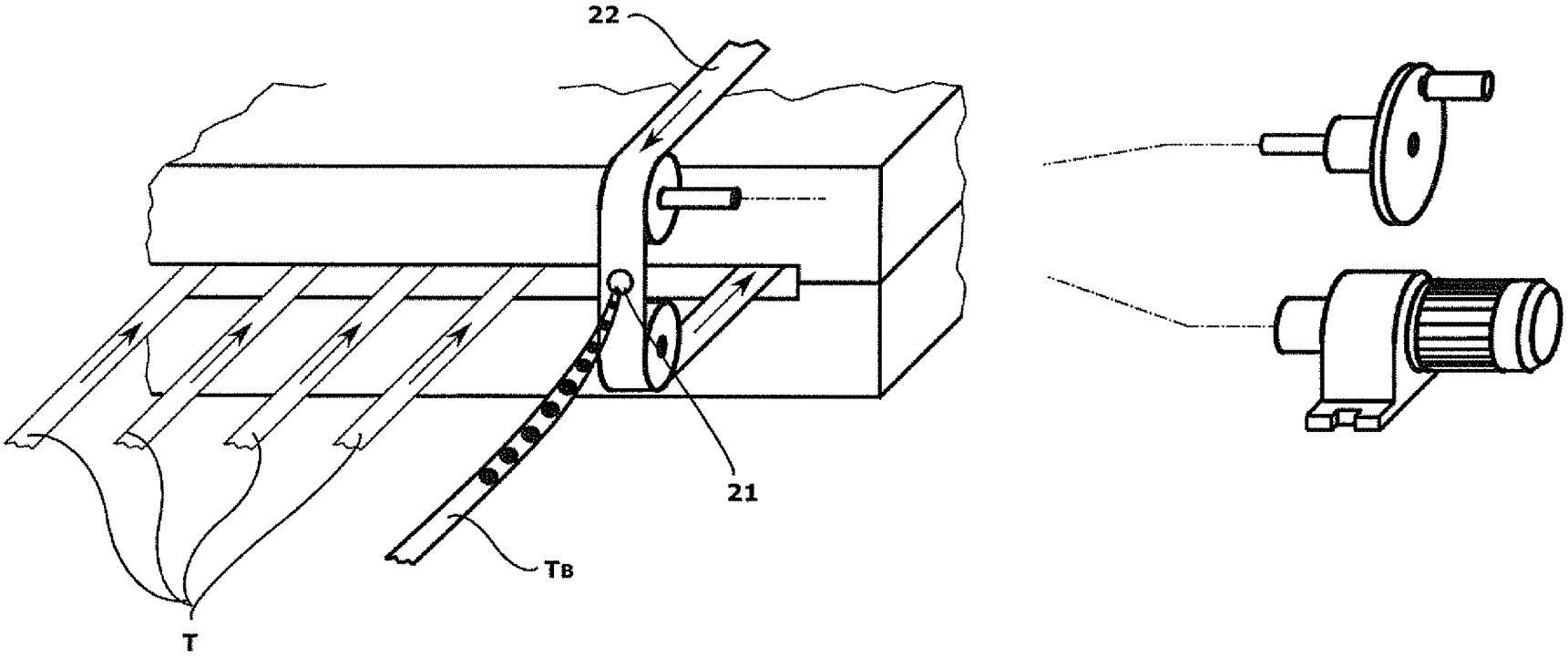
FIG. 7 is a perspective view from above of an end portion of the stretching apparatus according to the present invention, which illustrates in greater detail the drawing-in device of the same.

As initially stated, the present invention also relates to a drawing-in device of the tows which allows to draw-in a broken tow $T_B$ without having to interrupt the operation of the stretching apparatus according to the present invention. Such accessory device is illustrated in FIGS. 1 and 7 and comprises a flexible belt of thin steel 22, of 0.15-0.30 mm thickness, arranged along a closed loop path, on 4 or more transmission pulleys, one of said pulleys being associated with manual or motorised driving means. One of the branches of loop belt 22 is arranged within the steam stretching chamber 2, in a lateral position with respect to tows T, so as to create no interference with the same.

In FIG. 1 the path of broken tow $T_B$ is illustrated with different symbols depending on the different steps of the drawing-in process which follows the breakage of a tow T, which steps will be briefly described in the following.

In a first step, broken tow $T_B$ is inserted and sucked into a fixed suction unit 20 (discontinuous line --------).

In a second step, tow $T_B$ is taken from fixed unit 20 and cut. The free end of tow $T_B$ thus retained is fastened to a hole 21 suitably provided on the steel belt 22 of the drawing-in device (full circle ●●●●●●●●).

In a third step, the drawing-in device is actuated, manually or by a motor, to cause the belt to flow and thus bring the free end of broken tow $T_B$ into and beyond the stretching apparatus (cross line ++++++++), while the set of rolls $R_1$ continues to feed the tow which gathers in a container 23.

In a fourth step, said free end of broken tow $T_B$ is unfastened from belt 22 and wound around a capstan 24 which provides to retrieve the entire tow from container 23 tensioning it (empty circle line °°°°°°°°).

In the fifth and last step, the operator cuts the broken tow $T_B$ off the capstan and fastens it, with the help of a mobile sucking pistol, onto the drawing set of rollers $R_2$ in the position remained empty, corresponding to the outlet one of tow $T_B$ from set of rollers $R_1$. If the introduction of tow $T_B$ is performed passing below the other evenly moving tows T, broken tow $T_B$, due to the action of the drawing set of rollers $R_2$, is quickly brought back into its ordinary operating position, even in case said position lies laterally distant with respect to the position of the drawing-in device, and the operation of the stretching apparatus can continue without interruptions.

From the preceding description it is clear how the present invention has fully reached all the set objects. As a matter of fact, it has perfectly solved the main problems which up until today prevented the large-scale adoption of steam stretching apparatuses with rectangular-section stretching chamber. Due to the adoption of separate and insulated elements for the "hot" stretching chest and the relative "cold" supporting structure, the problem of incontrollable thermal deformations which a very wide and long stretching chamber undergoes when it is brought at a high temperature has been fully solved. This occurs also due to a greater structural rigidity of the cold supporting structure with respect to the hot chest: the cold supporting structure is thus able to forcedly maintain planar the hot chest despite the inner stresses due to thermal expansion which develop in the same, which stresses might lead to chest arching and twisting, if it was free from constraints. Due to the special shape of the labyrinth pressure seals, the problem has been solved of supplying an adequate and stable pneumodynamic positioning of the tows between the opposite fixed walls of said seals and a limitation of steam losses from the inlet and outlet slits of said chamber has been obtained. Finally, the stretching apparatus of the present invention, due to the construction of the stretching chest in two opposite portions which can be easily opened, enormously facilitates the initial drawing-in operations of the tows and, due to the drawing-in device, allows to recover tow breakage situations without interrupting the processing on the remaining tows. The damages due to missed production are hence dramatically reduced with respect to the prior art apparatuses wherein any problem, arising even on only one of the side-by-side tows, necessarily required the interruption of the processing on the entire stretching apparatus.

However, it is understood that the invention must not be considered limited to the special arrangements illustrated above, which represent only exemplifying embodiments thereof, but that a number of variants are possible, all within the reach of a person skilled in the field, without departing from the scope of protection of the invention, which is exclusively defined by the attached claims.

The invention claimed is:

1. A stretching apparatus of fibre tows in a pressurized steam environment, of the type comprising an elongated stretching chamber (2) having a generally rectangular section having a length, a width and a low height, within which the tows (T) are treated with saturated or overheated steam at high temperature and pressure and simultaneously undergo a mechanical stretching operation, wherein the width of said stretching chamber (2) is sufficient to house multiple tows (T) mutually flanked in a tow running plane, wherein said stretching chamber (2) is formed within a metal stretching chest (1), free to expand in the directions of said length and said width within a surrounding rigid, pressure-resistant supporting structure (3-9), which supporting structure exactly determines a position of said stretching chest (1) in a direction of said height, through a plurality of contact elements (8, 9).

2. The stretching apparatus as claimed in claim 1, wherein said plurality of contact elements (8-9) of said supporting structure (3-9) determine a predefined position of the stretching chest (1) with respect to a direction perpendicular to the tow running plane (z axis) while allowing a limited mobility of the stretching chest (1), in the other two mutually perpendicular directions which lie in said tow running plane (x and y axes), length and width respectively, said limited mobility being sufficient to allow the free thermal expansion of the stretching chest (1) in these two directions.

3. The stretching apparatus as claimed in claim 2, wherein said stretching chest (1) consists of two opposite, mutually facing upper and lower portions, provided with two longitudinal edges and two transversal edges, said portions being in mutual contact through gaskets (19) laid in between along said two longitudinal edges thereof, said portions being internally shaped to form said low-height stretching chamber (2), outwardly open at said two transversal edges of the stretching chest (1) through tow (T) inlet and outlet slits (13).

4. The stretching apparatus as claimed in claim 3, wherein for each of said two opposite portions of the stretching chest (1), one of said contact elements (8, 9) determines a predefined position of said portion also with respect to the two perpendicular directions which lie in the tow running plane (x and y axes).

5. The stretching apparatus as claimed in claim 3, wherein said supporting structure comprises a base frame (3), provided with contact elements (9) whereon the lower portion of said stretching chest (1) rests, and multiple collars (4) which can be fastened to said base frame (3), mutually parallel and perpendicular to the length direction of the stretching chest (1), provided with contact elements (8) which contact elements (8) rest on the upper portion of said stretching chest (1) and define the position thereof when fastened to said base frame (3).

6. The stretching apparatus as claimed in claim 5, wherein each one of said collars (4) can be fastened to said base frame (3) or to crossmembers (7) projecting from said base frame (3), through a hinge (5) at a first end of the collar and a lever tie rod (6) at an opposite, second end of the collar.

7. The stretching apparatus as claimed in claim 6, wherein said collars (4) are made mutually integral by a longitudinal post.

8. The stretching apparatus as claimed in claim 5, wherein the contact elements of the base frame (3) consist of supporting rods (9) provided with a contact head which cooperates with a hardened steel insert secured in the lower portion of said stretching chest (1).

9. The stretching apparatus as claimed in claim 5, wherein the contact elements of the collars (4) consist of contrast rods (8), whose height is adjustable by screw means, provided with a contact head which cooperates with a hardened steel insert secured in the upper portion of said stretching chest (1).

10. The stretching apparatus as claimed in claim 8, wherein a part of said inserts is arranged in correspondence of the longitudinal axis of said two portions of the stretching chest (1) and is provided with guiding grooves comprised with lateral shoulders, within which a mushroom-shaped end of the contact head of said supporting rods (9) is housed.

11. The stretching apparatus as claimed in claim 3, furthermore comprising a pressure seal at each one of the slits (13) for the inlet/outlet of the tows (T), said seal consisting of two opposite plates (14), each one integral with a respective portion of the stretching chest (1), mutually facing at a short distance, the inner surface of the plates being provided with a series of symmetrically arranged, parallel grooves, in a direction perpendicular to a tow running direction.

12. The stretching apparatus as claimed in claim 11, wherein the distance (A) between the opposite plates (14) of the pressure seal lies in the range 0.3-2.0 mm.

13. The stretching apparatus as claimed in claim 11, wherein a length (L) of the opposite plates (14) is proportional to the distance (A) between said plates and to a steam pressure (P) within the stretching chamber (2) through a coefficient K according to the formula:

$$L=A\times K\times P.$$

14. The stretching apparatus as claimed in claim 11, wherein the grooves of the opposite plates (14) have a longitudinal fret-like toothing with right angles and sharp edges and jointly form a succession of deep compartments separated by bottleneck areas in correspondence of non-grooved parts of the opposite plates (14).

15. The stretching apparatus as claimed in claim 14, wherein a length of said bottleneck areas (B), a pitch (C) of said longitudinal fret-like toothing and a depth (D) of said compartments are linked with each other and to the distance (A) between said plates by the following relationships:

$$2/10C\leq B\leq 5/10C$$

$$10A\leq C\leq 20A$$

$$6\leq D\leq 15A.$$

16. The stretching apparatus as claimed in claim 11, wherein an outer end of the opposite plates (14) forming said pressure seals of the stretching chamber (2) is connected to the inside of a suction hood (15) wherein the slit (13) for the inlet/outlet of the tows (T) also opens, on the opposite side of the said pressure seals, said suction hood (15) being connected to a suction device maintaining a slight depression within said suction hood (15).

17. The stretching apparatus as claimed in claim 16, wherein said opposite plates (14) forming pressure seals extend into the stretching chamber (2), and said stretching chamber (2) extends above said suction hood (15).

18. The stretching apparatus as claimed in claim 17, wherein said opposite plates (14) are mechanically connected to the adjoining walls of the stretching chamber (2) through rigid connecting elements (17).

19. The stretching apparatus as claimed in claim 17, wherein in the upper area of the stretching chamber (2) a heating coil (18) is arranged, which heating coil (18) is fed with overheated steam to maintain this area constantly above the steam dew temperature.

20. The stretching apparatus as claimed in claim 1, wherein said stretching chest (1) is made of aluminium or of an aluminium alloy and said supporting structure (3-9) is made of steel.

21. The stretching apparatus as claimed in claim 20, wherein said supporting structure (3-9) has a greater structural rigidity than said stretching chest (1), and said supporting structure (3-9) is therefore capable of forcedly maintaining planar the stretching chest (1), when the stretching chest (1) is hot, despite the presence of inner stresses due to thermal expansion which could induce arching and twisting of the stretching chest (1) in the absence of constraints.

22. A drawing-in device of tows in a stretching apparatus as claimed in claim 1, wherein said drawing-in device comprises a thin and flexible steel belt (22), arranged along a closed loop path comprising two branches, on transmission pulleys, one of the branches of said steel belt (22) being arranged within said stretching chamber (2).

23. The drawing-in device of tows as claimed in claim 22, wherein said flexible belt (22) comprises fastening means (21) of a free end of a broken tow ($T_B$).

24. The drawing-in device of tows as claimed in claim 23, wherein one of said pulleys is driven by manual or motorised driving means.

25. The drawing-in device of tows as claimed in claim 23, wherein said branch of the steel belt (22) arranged within the steam stretching chamber (2) is located in a lateral position with respect to the tows (T), and said broken tow ($T_B$) is fastened to said belt (22) causing said broken tow ($T_B$) to pass below the tows (T) , in order to obtain an automatic repositioning of the broken tow ($T_B$) in an ordinary operating position due to the action of a drawing set of rollers ($R_2$).

* * * * *